US005691598A

United States Patent [19]

Belle et al.

[11] Patent Number: 5,691,598

[45] Date of Patent: Nov. 25, 1997

[54] FLUORESCENT LAMP WITH THERMAL HEAT SHIELD BETWEEN LAMP TUBE AND BALLAST CIRCUITRY

[75] Inventors: Kelvin B. Belle, Willoughby Hills, Ohio; Leon F. Chamberlain, Palm Springs, Calif.; Raymond A. Fillion, Schenectady, N.Y.; Jozsef Fulop, Budapest, Hungary; David J. Kachmarik, North Olmsted, Ohio; Donald W. Kuk, Albany, N.Y.; Robert S. McFeely, Valley View, Ohio; Ferenc Papp; Istvan Wursching, both of Budapest, Hungary

[73] Assignee: General Electric Company, Schenectady, N.Y.

[21] Appl. No.: 569,019

[22] Filed: Dec. 7, 1995

[51] Int. Cl.[6] ..... H01J 1/62; H01J 63/04; H01J 1/02; H01J 7/24

[52] U.S. Cl. ..... 313/493; 313/43; 313/492; 313/634; 315/58

[58] Field of Search ..... 313/43, 242, 492, 313/493, 626, 634; 439/226, 231, 236; 315/58

[56] References Cited

U.S. PATENT DOCUMENTS

| | | | |
|---|---|---|---|
| 1,670,716 | 5/1928 | Donovan | 313/242 |
| 2,084,999 | 6/1937 | Birdseye | 313/43 |
| 2,664,513 | 12/1953 | Morgan | 313/242 |
| 2,671,183 | 3/1954 | St. Louis et al. | 313/43 |
| 2,976,441 | 3/1961 | Stahl | 313/43 |
| 3,007,069 | 10/1961 | Edwards | 313/43 |
| 3,283,198 | 11/1966 | Bellott et al. | 313/242 |
| 3,688,148 | 8/1972 | Fedorenko et al. | 313/493 X |
| 3,953,726 | 4/1976 | Scarritt, Sr. | 313/60 X |
| 4,308,650 | 1/1982 | Hernandez et al. | 313/492 X |
| 4,383,200 | 5/1983 | Van Zon et al. | 313/493 X |
| 4,449,072 | 5/1984 | Osada | 313/493 X |
| 4,490,649 | 12/1984 | Wang . | |
| 4,500,810 | 2/1985 | Graff | 313/492 X |
| 4,503,358 | 3/1985 | Kamei et al. | 313/493 X |
| 4,794,301 | 12/1988 | Misono et al. | 313/493 X |
| 4,870,317 | 9/1989 | Dannert et al. | 313/43 X |

*Primary Examiner*—Sandra L. O'Shea
*Assistant Examiner*—Mack Haynes
*Attorney, Agent, or Firm*—George E. Hawranko

[57] ABSTRACT

A fluorescent lamp includes a lamp tube having first and second ends and containing fill materials for causing light generation when provided with electrical power. The lamp further includes first and second power-transferring means at the first and second ends of the lamp tube, respectively, for providing the fill materials in the lamp tube with electrical power. Also included is a thermal heat shield separating the first power-transferring means from ballast circuitry which supplies power to the first power-transferring means and which has a lifetime that becomes substantially less as its operating temperature increases. The thermal heat shield is constructed so that it reflects back to the first power-transferring means and any adjacent portion of the lamp tube sufficient radiant energy to reduce the operating temperature of the ballast circuitry by more than about one degree Celsius compared with the absence of the heat shield.

17 Claims, 6 Drawing Sheets

FLUORESCENT LAMP WITH THERMAL HEAT SHIELD BETWEEN LAMP TUBE AND BALLAST CIRCUITRY

FIELD OF THE INVENTION

The present invention has two aspects. One relates to a lamp cathode-to-ballast interconnect and method of making such interconnect, and, more particularly, to such an interconnect and method that can be highly automated. A second aspect relates to a fluorescent lamp employing a thermal heat shield between lamp tubes and ballast for extending ballast life. The appended claims are directed towards the second aspect of the invention.

BACKGROUND OF THE INVENTION

Compact fluorescent lamps typically comprise a lamp tube with a number of 180° convolutions, or bends, to achieve compactness, while maintaining a long tube length. Located at each end of the lamp tube is a respective pair of elongated conductors connected across the ends of a filament-heated type of cathode within the lamp tube. Such conductors are referred to herein as cathodes, or elongated cathodes. The cathodes are connected to ballast circuitry to suitably condition the current supplied to the cathodes. The ballast circuitry, in turn, is typically connected to an Edison-type screw base for installation into a conventional incandescent lamp socket. A first aspect, or feature, of the present invention relates in particular to the lamp cathode-to-ballast connection.

One prior art practice of connecting lamp cathodes to ballast circuitry has been to make such connection using so-called wire crimps. Thus, the end of a cathode is placed in one end of a wire crimp (i.e., a cylindrically shaped conductive member), and a wire from the ballast circuitry is placed in the other end of the wire crimp. The wire crimp is then compressed to make a mechanically and electrically sound connection between cathode and ballast circuitry. The installation of a wire crimp, however, has been carried out with manual labor. Especially due to the small dimensions involved, the use of wire crimp is a difficult and, hence, expensive procedure.

Concerning a second aspect (or feature) of the invention, a trend in the design of compact fluorescent lamps has been to increase lamp wattage, to achieve higher light output. Such lamps include an envelope, or tube, in which suitable fill materials are provided to produce light. The cathodes of the lamps are of the filament-heated type, and are maintained at a high temperature to assure proper lamp operation. With the ballast circuitry for the lamp positioned adjacent lamp tube and heated lamp cathodes, the increased heat from the increased-wattage lamps causes ballast temperature to increase. It is known that for every 10 degrees Celsius increase in temperature, the wear out of various ballast components (e.g., electrolytic capacitors) is accelerated by about 50 percent. Other factors increase ballast temperature, such as placing ballast circuitry within a recessed fixture that limits ballast cooling, or including an amalgam in the fill of the lamp tube which results in system temperature increase in certain application (e.g., in a recessed lamp fixture).

As detailed below, the present inventors performed a considerable number of thermal studies on compact fluorescent lamps to determine a simple (e.g., low cost) and effective approach to limiting ballast temperature.

OBJECTS AND SUMMARY OF THE INVENTION

Accordingly, an object of a first aspect of the invention is to provide a lamp cathode-to-ballast interconnect and method of making such interconnection that can be highly automated.

A further object of the first aspect of the invention is to provide such interconnect and method wherein making of the lamp cathode-to-ballast interconnect can be so highly automated as to avoid the above-described, prior art crimping operation.

Another object of the first aspect of the invention is to provide such interconnect and method with minimal complexity and cost.

An object of a second aspect of the invention is to provide a fluorescent lamp in which ballast temperature is significantly reduced and ballast lifetime thus significantly lengthened.

A further object of the second aspect of the invention is to enable a fluorescent lamp to operate with increased lifetime of its ballast circuitry when the lamp is positioned in a relatively hot (e.g., recessed) fixture.

A still further object of the second aspect of the invention is to realize the foregoing, two objects by the use of a thermal heat shield that can be provided at low cost.

In accordance with the second aspect of the invention, there is provided in preferred form a fluorescent lamp, including a lamp tube having first and second ends and containing fill materials for causing light generation when provided with electrical power. The lamp further includes first and second power-transferring means at the first and second ends of the lamp tube, respectively, for providing the fill materials in the lamp tube with electrical power. Also included is a thermal heat shield separating the first power-transferring means from ballast circuitry which supplies power to the first power-transferring means and which has a lifetime that becomes substantially less as its operating temperature increases. The thermal heat shield is constructed so that it reflects back to the first power-transferring means and any adjacent portion of the lamp tube sufficient radiant energy to reduce the operating temperature of the ballast circuitry by more than about one degree Celsius compared with the absence of the heat shield..

BRIEF DESCRIPTION OF THE DRAWING FIGURES

In the following detailed description, reference will be made to the attached drawings in which like reference numerals refer to like, or corresponding elements, throughout the following figures.

DETAILED DESCRIPTION OF THE PREFERRED EMBODIMENTS

Figure 1:
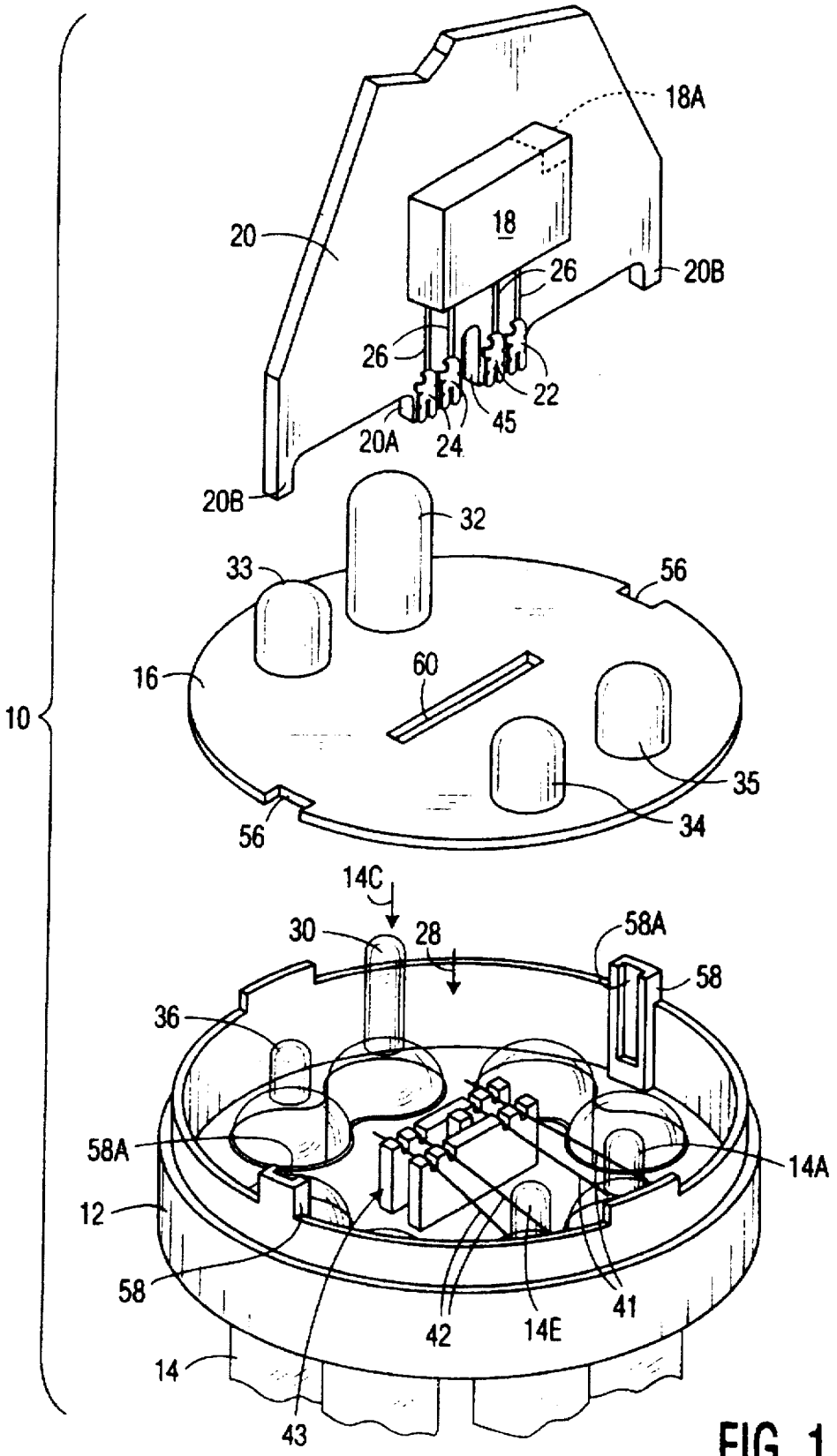
FIG. 1 is a simplified, exploded view in perspective of a compact fluorescent lamp incorporating both heat shield and lamp cathode-to-ballast interconnect features of the present invention.

FIG. 1 shows selected parts of a compact fluorescent lamp 10 embodying both heat shield and lamp cathode-to-ballast interconnect features of the present invention. Lamp 10 includes a plastic cap 12, shown in simplified form, for holding the upper-shown ends of a convoluted lamp tube 14. Lamp tube 14 contains suitable fill materials for producing light. A thermal heat shield 16, in accordance with one aspect of the invention, reduces the temperature of ballast circuitry 18 to increase its lifetime. Ballast circuitry 18 is schematically shown as a box, although in practice it is realized on a printed-circuit board (PCB) 20 as individual components, such as resistors, special purpose integrated circuit configurations, and inductor windings, etc. Ballast circuitry 18 may be connected to an Edison-type screw base (not shown) for being received in a conventional incandescent lamp socket.

Conductive clips 22 and 24 are mounted on the lower-shown portion of PCB 20, and are part of the lamp cathode-to-ballast interconnect of the invention. They are connected to ballast circuitry 18 by printed conductors 26 on the PCB, and will be described in detail below.

Figure 2:
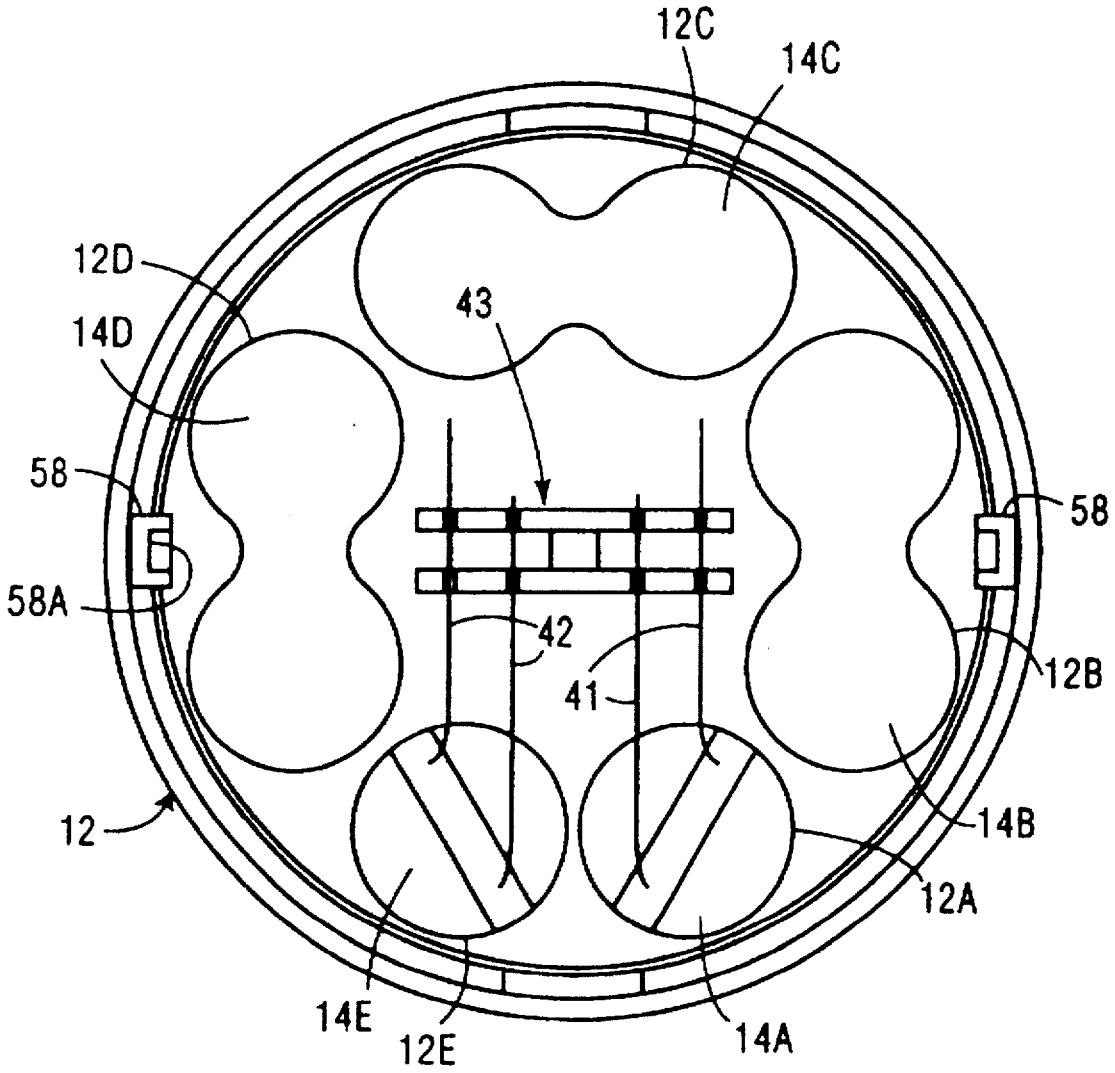
FIG. 2 shows parts of the lamp of FIG. 1 from the perspective of an arrow 28 in FIG. 1.

Viewing cap 12 in a downward perspective as indicated by arrow 28 in FIG. 1, FIG. 2 shows convolutions of one end of lamp tube 14 more clearly. A first lamp tube end 14A protrudes upwardly through aperture 12A of cap 12. From end 14A, lamp tube 14 projects downwardly in a linear direction for some length, and then undergoes a full (e.g. 180°) bend to project upwardly through cap aperture 12B as tube portion 14B, and, after another full bend, back downwardly through the upper-shown portion of aperture 12B. Similar convolutions (or bends) occur with lamp portion 14C and cap aperture 12C, and with tube portion 14D and aperture 12D. A second end of lamp tube 14 is shown as lamp end 14E, which projects upwardly through aperture 12E. Lamp tube 14 thus undergoes seven full bends, although the invention applies to lamps with other numbers of bends.

Referring back to FIG. 1, lamp end (or tip) 30 of lamp tube portion 14C projects upwardly more than the other lamp ends shown; it may comprise a so-called amalgam tip for containing an amalgam used as part of the mentioned fill materials in lamp tube 14. Thermal heat shield 16 accommodates lamp tip 30 by including a tip cover 32 for receiving tip 30. Similar tip covers 33, 34 and 35 accommodate lamp tips 36, 14E and 14A, respectively.

Figure 3:
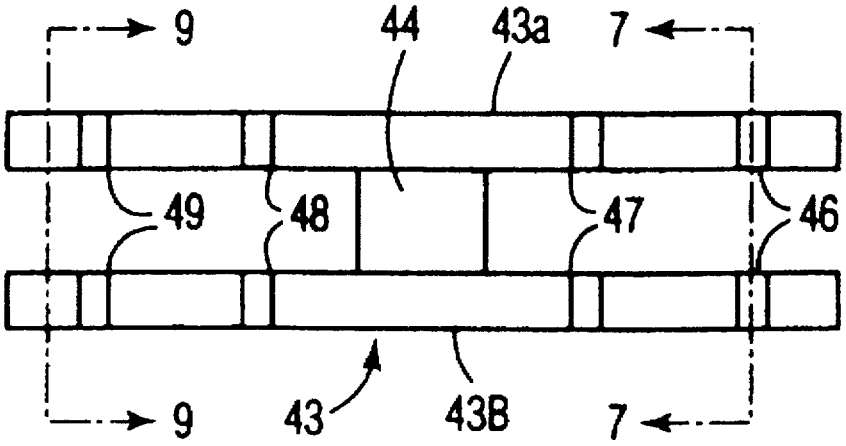
FIG. 3 is a detail upper plan view of a loom 43 shown in FIG. 1.

Elongated cathode 41, from lamp tip 14A, and cathode 42, from lamp tip 14E, are connected to a loom 43. Two cathodes exit each tip end to accommodate filament-heated cathode portions (not shown) within the lamp tube. Loom 43 holds cathodes 41 and 42 in place for connection to respective conductive clips 22 and 24 on PCB 20. Loom 43 is preferably formed integrally with plastic cap 12, and receives cathodes 41 and 42 in respective grooves; such grooves are numbered in the detail upper plan view of the loom in FIG. 3 as grooves 46, 47, 48 and 49. Referring to FIG. 3, loom 43 may comprise a pair of spaced walls 43A and 43B. A locating projection 44, preferably higher than walls 43A and 43B, cooperates with a groove 45 in PCB 20 (FIG. 1), to help locate the PCB with respect to loom 43. Projection 44 is preferably integral with plastic cap 12 (FIG. 1), and with loom walls 43A and 43B.

Figure 4:
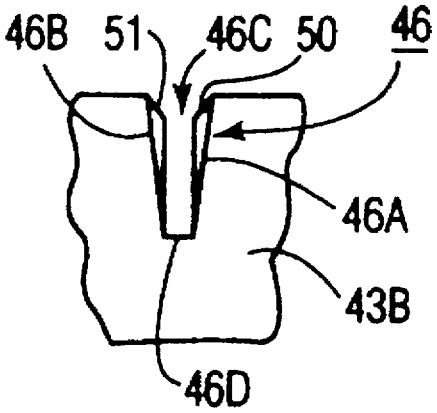
FIG. 4 is a detail side plan view of groove 46 of FIG. 3.
Figure 5:
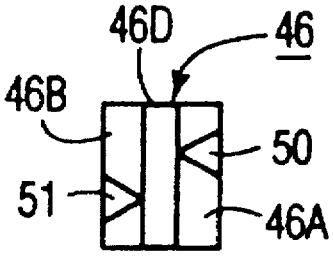
FIG. 5 is an detail upper plan of groove 46 of FIG. 4.

It is important for grooves 46–49 (FIG. 3) to tightly grip the cathodes portions received therein, as will be explained below. Thus, as shown in the detail view of groove 46 in FIG. 4, walls 46A and 46B of groove 46 cooperate to form a wedge-shape as shown. Wall 46A further includes a spline 50, while wall 46B includes a further spline 51. Both splines extend nearly the depth of groove 46, i.e., from groove opening 46C to groove bottom 46D. Splines 50 and 51 are preferably offset from each other, as shown in the detail upper plan view of FIG. 5. A cathode (not shown) received in the groove 46 will have a diameter larger than the transverse dimension of groove bottom 46D. As the cathode is pressed downwardly in the groove, the wedge-like narrowing of the groove, coupled with the splines pressing against the cathode, cause the cathode to be securely held in place for a purpose explained below.

Figure 6:
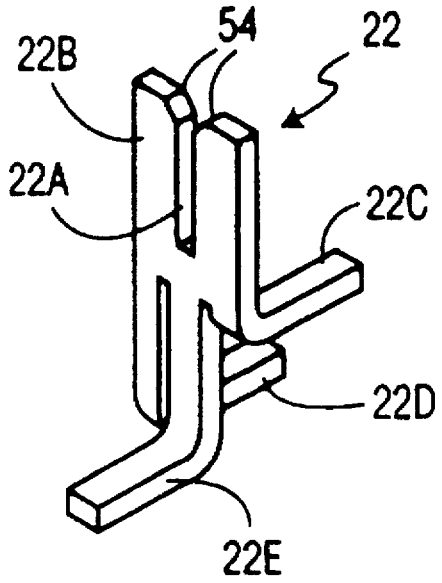
FIG. 6 is a perspective view of a conductive clip 22 of FIG. 1.
Figure 6A:
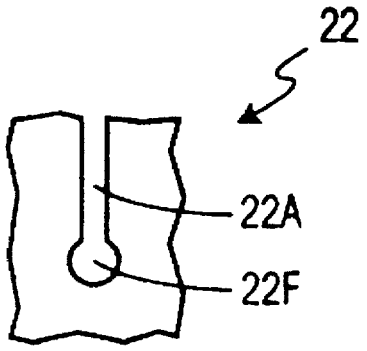
FIG. 6A is a detail view of the clip of FIG. 6.

Referring now to the detail view of FIG. 6, a conductive clip, e.g., 22 of FIG. 1 is shown in a preferred form. Clip 22 includes a pinching groove 22A formed through a generally flat portion 22B of the clip. Slanted regions 54 at the "mouth" of the groove help guide a cathode into the groove. Clip 22 includes a pair of legs 22C and 22D for insertion into respective apertures (not shown) in PCB 20 (FIG. 1). The use of two such legs provides an anti-rotation mechanism for the clip. A further leg, 22E, projects in an opposite direction from legs 22C and 22D, and constitutes a handle to allow an automatic pick-and-place machine (not shown) to pick (i.e. grip) clip 22 and install it onto the PCB. Preferably, the bottom of dip 22 includes a relatively enlarged, circular hole 22F as shown in the detail view of FIG. 6A. This causes the left and rights sides of the clip, as shown in FIG. 6A, to exhibit spring-like resilience for pressing against a cathode (not shown).

Figure 7:
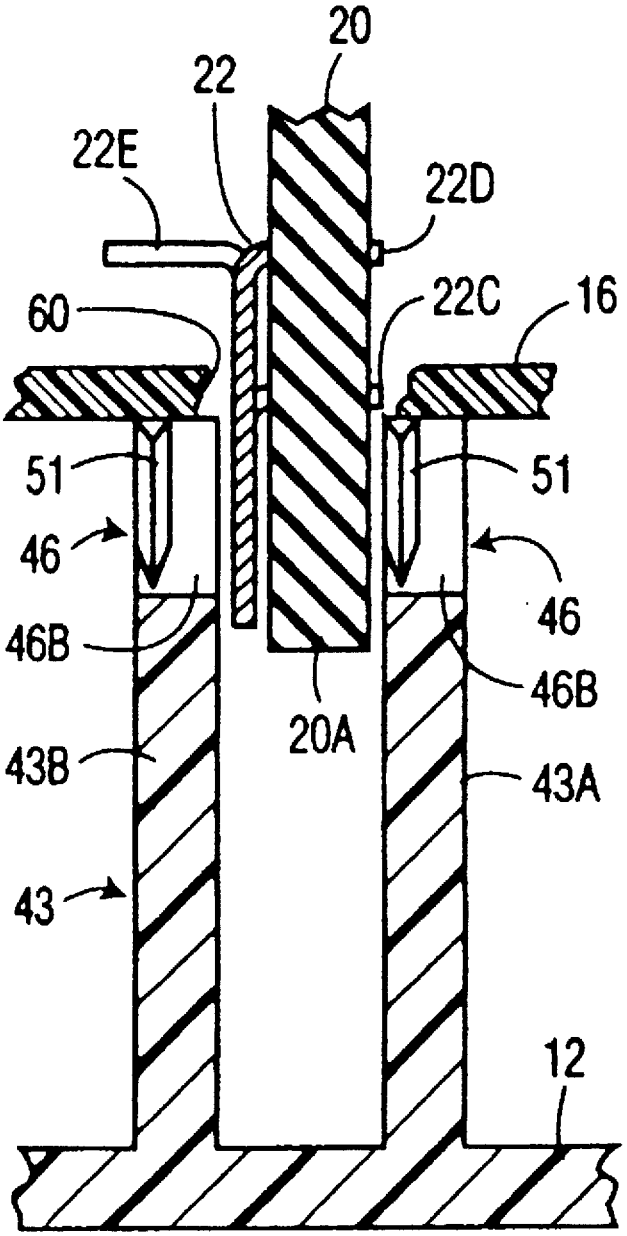
FIG. 7 is a detail cross-sectional view of an assembled lamp cathode-to-ballast interconnect taken at arrows 7, 7 in FIG. 3, omitting cathode 41 for clarity.

An assembled lamp cathode-to-ballast interconnect is shown in FIG. 7. As shown therein, heat shield 16 rests atop loom 43. Splines 51 of each of grooves 46 are shown in full, while PCB 20 and the remainder of walls 43A and 43B of the loom are shown in cross section. Clip 22 is shown, together with its various legs 22C, 22D and 22E described above.

Figure 8:
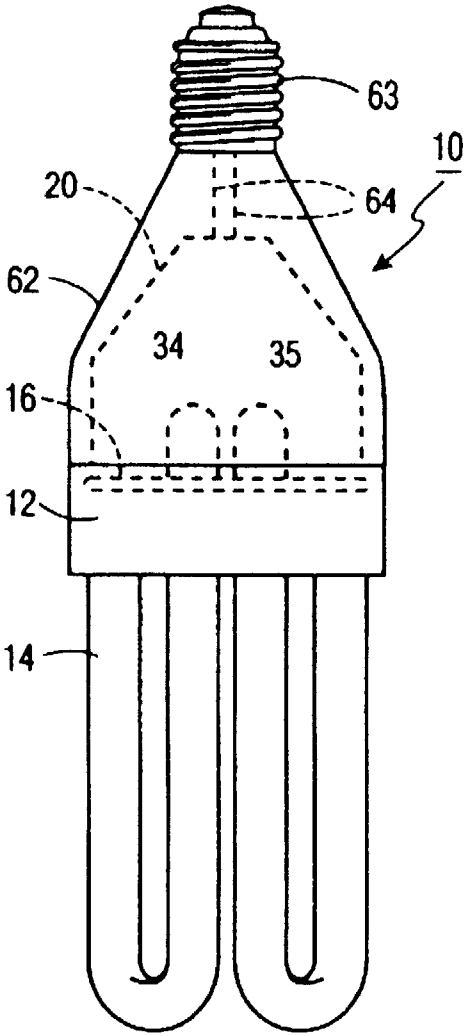
FIG. 8 is a simplified, side plan view of an assembled lamp in accordance with the invention.

FIG. 8 shows a simplified, side plan view of an assembled lamp 10, in which a ballast housing 62 attaches to cap 12 in a conventional manner, and encloses PCB 20. PCB 20, in turn, is connected to an Edison-type screw base 63 by means of schematically shown conductors 64. Thermal heat shield 16, with (lamp tube) tip caps 34 and 35, for instance, separates ballast circuitry (not shown) on PCB 20 from the adjacent tips (or ends) of lamp tube 14. Details of thermal heat shield 16 will be provided below.

In assembling the parts of the lamp shown in FIG. 1, a pick-and-place machine (not shown) may advantageously pick (i.e., grip) each of cathodes 41 and 42, and place it in its respective groove in loom 43. Such automation of the previous hand-made connection described in the Background of the Invention above is illustrated in FIG. 9.

Figure 10:
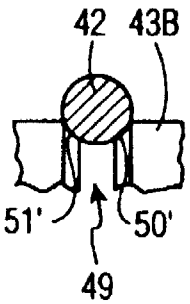
FIG. 10 is a detail of a groove of an interconnect loom with a cathode resting partially within the groove, and is similar to FIG. 4.
Figure 9:
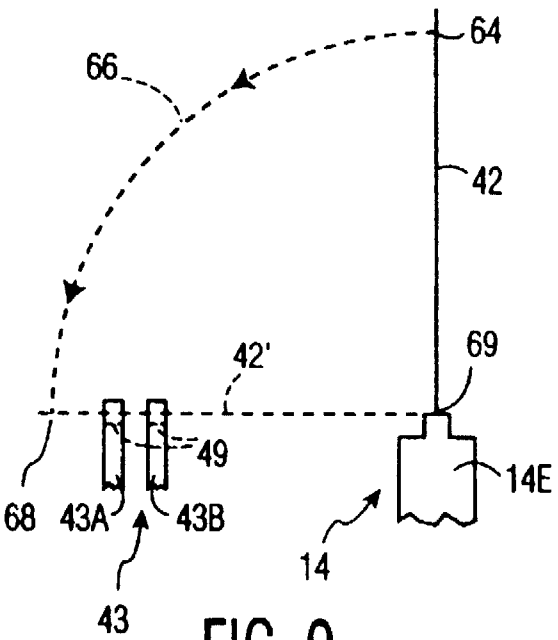
FIG. 9 is a simplified view showing the automatic positioning of a cathode into a loom of the interconnect feature of the invention, and is taken at arrows 9, 9 in FIG. 3.

FIG. 9, taken at arrows 9, 9 in FIG. 3, shows the picking and placing of cathode 42 into loom 43. Preferably, cathode 42 is first extended upwards, as shown, in alignment with the illustrated portion of lamp tube 14. A pick-and-place machine then grips cathode 42 at point 64, for instance, and moves such point along arc 66 to reach point 68. Preferably, arc 66 is approximately tangential about axis 69 where cathode 42 exits lamp tip 14E; this minimizes bending of cathode 42 while it is being positioned atop loom 43. Cathode 42' then rests partially within groove 49 as shown in FIG. 10, which is a detail of groove 49 similar to FIG. 4. In this manner, cathode 42 is inserted laterally into grooves 49 with respect to the longitudinal dimension (not shown) of the grooves. At this point, cathode 42 appears as shown in phantom at 42'.

Figure 11:
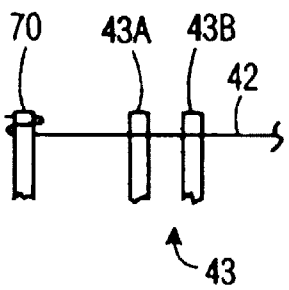
FIG. 11 shows a left-most portion of a cathode being held taught by a post 70 around which it is wrapped, in accordance with one embodiment of the invention.

If desired, the left-most shown portion of cathode 42, as shown in FIG. 11, can be held taught by, for instance, being wrapped around a post 70 as shown that is stationary with respect to loom 43. However, if cathode 42 is sufficiently stiff, the use of post 70 can be dispensed with.

A pick-and-place machine can pick and place any one or any combination (e.g. all) of the four cathodes 41 and 42 simultaneously. Such machine may be a machine specifically made to perform the described pick-and-place operation, or could be a general purpose machine programmed to perform the specific operation required herein.

Referring back to FIG. 1, thermal heat shield 16 is then positioned inside cap 12, with guide members 58 of the cap being received within slots 56 of the heat shield. Heat shield 16 can be positioned to rest atop loom 43, as more clearly shown in the detail, assembled view of FIG. 7. Preferably, heat shield 16 snap fits around loom 43, locking the free ends of cathodes 41 and 42 in place. "Ears" 20A of PCB 20, with clips 22 and 24 thereon, are then inserted through slot 60 in thermal heat shield 16. Simultaneously, ears 20B of PCB 20 are received within guide slots 58A in guide members 58 of cap 12, so as to guide the interconnection of clips 22 and 24 with cathodes 42 and 43. Further guiding such interconnection is locating projection 44 shown in FIG. 3. During insertion of ears 20A of PCB 20 into the space between loom walls 43A and 43B (e.g., FIG. 3), cathodes 41 and 42 are respectively received within pinching grooves 22A (FIG. 6) of the clips. As this occurs, the adjacent portions of the cathodes are pressed downwardly into their respective grooves in the loom, securing the cathodes within the grooves as explained above in connection with FIGS. 4 and 5. During this time, the pinching grooves of clips 22 and 24 pinch the cathode portions received within such grooves, so as to form a so-called gas-tight seal between the clips and the cathodes.

With regard to the lamp cathode-to-ballast interconnect feature of the invention, pinching groove 22A (FIG. 6) of clip 22, for instance, may have a typical width of 0.275 millimeters where the diameter of the cathode to be received within the groove is 0.032 millimeters. Hole 22F of the clip, as shown in FIG. 6A, is larger in diameter than the rest of groove 22A. Clip 22 is preferably formed of beryllium-copper or of other conductive material exhibiting a similar stiffness. Cathodes 41 and 42 may comprise nickel-plated steel, by way of example. Using the foregoing dimensions and materials has been found to result in a gas-tight seal between the cathodes and the conductive clips, which retards oxidation of the contact over time.

The lamp cathode-to-ballast interconnect feature of the present invention is especially useful for compact fluorescent lamps, in which cost considerations are paramount. This is because such lamps are intended to replace low cost incandescent lamps purchased by individual (i.e., non-institutional) consumers. However, the interconnect feature can also be used with other lamps having cathodes, such as low pressure or high pressure sodium lamps, high intensity discharge lamps, mercury discharge lamps, or low voltage incandescent lamps using ballast circuitry for voltage reduction.

Further referring to FIG. 8, further details of the second aspect of the invention, i.e., the thermal heat shield, are now described. As mentioned above, the lifetime of various electronic components of ballast circuitry in a compact fluorescent lamp will decrease as their operating temperature increases. In a compact fluorescent lamp of the type illustrated, employing filament-heated cathodes, the present inventors have discovered from thermal tests that approximately one-third of the heat generated in the lamp originates from so-called wall losses of lamp tube 14; that approximately one-third of the heat originates from the filament-heated cathodes (not shown); and that approximately one-third of the heat originates from ballast circuitry typically mounted on printed-circuit board (PCB) 20. It is further known that heat transfer amongst the foregoing parts of the lamp may occur by the three thermal-transfer modes of convection, conduction and radiation. However, the relative importance amongst the three heat transfer modes was not understood; as a consequence, the knowledge of an effective, low cost solution to reducing ballast temperature was unavailable.

In searching for an effective low cost solution to reducing ballast temperature, the present inventors undertook a considerable number of thermal tests on a compact fluorescent lamp as shown in FIG. 8. Among the tests conducted were the following, separate tests: (1) Sand was included within ballast housing 62 to improve the cooling path from the ballast to the housing and base 63. (2) Heat spreaders (not shown) were placed around magnetic coils (not shown) of the ballast circuitry to isolate heat generated by such coils from an electrolytic capacitor (not shown) of the ballast circuitry. (3) Metal pads (not shown) were placed around the mentioned power FETs to better distribute heat from the FETs. (4) Slots (not shown) of varying sizes and location were made in plastic ballast housing 62 to provide convective cooling path(s) for the ballast circuitry. (5) Thick copper wires of 45 milli-inch diameter rather than the nominal 25 milli-inch diameter were used as conductors 64 to increases the thermal conductive path from the ballast circuitry on PCB 20 to base 63. (6) Thermally conductive epoxy was applied between an electrolytic capacitor (not shown) in the ballast circuitry and both ballast housing 62 and base 63, to improve the thermal path away from the capacitor. (7) The lamp tube 14 was rotated 180° relative to the ballast circuitry to move the filament-heated cathodes (not shown) away from the mentioned magnetic coils. (8) A clear plastic housing 62 was used in place of a normally opaque housing. (9) A magnetic inductor serving as the resonant inductor of a resonant tank was removed from housing 64 and placed externally of such housing. (10) The exterior of ballast housing 64 was metallized with 1 to 2 millimeters of copper to increase thermal spreading on its plastic surface. (11) Interior ridges were formed on ballast housing 64 to increase its heat-emitting surface area. (12) Lamp tube 14 was separated from the ballast circuitry to thermally isolate them from each other. (13) A copper heat spreader (not shown) with 1.2 mils thickness was added to a non-circuit side of PCB 20 to provide thermal heat spreading. (14) The surface of cap 12 facing the ballast circuitry was dimpled toward such circuitry to let more light and heat pass away from the circuitry, increasing the net light output of the tube. (15) White thermal glue was used instead of dark glue that holds lamp tube 14 in cap 12 to both reflect more light back towards the tube and to thermally isolate the cathode-generated heat from the ballast circuitry. (16) The mentioned electrolytic capacitor was moved further towards base 63 to both isolate it from the hotter ballast components and to move it closer to the cooler base. (17) The filament-heated cathodes were moved higher up within respective portions of lamp tube 14. (18) A horizontally oriented printed-circuit board, from the perspective of FIG. 8, was used instead of the vertically oriented PCB 20 shown. (19) A non-glossy and non-metallized heat shield 16 of Valox® plastic was used, as shown, to thermally isolate lamp tube 14 from the ballast circuitry. (20) A non-metallized heat shield 16 of Valox® plastic was similarly used, but with the side facing lamp tube 14 having a surface that had been polished to present a glossy surface. (21) A heat shield 16 of Valox® plastic, with 1 to 2 millimeters of copper metallization on the ballast side, was used to thermally isolate and block radiant light and infra-red energy emanating from the lamp tube 14 to the ballast circuitry.

The Valox® plastic referred to herein is available as product No. 420SEO, available from the General Electric Company of Fairfield, N.Y. Such material is of a polyester-based family of plastics, specially processed to give the attributes of a good flammability rating (i.e., Underwriters Laboratory rating of V-O) in a thin wall section. The material has a high structural strength resulting from a crystalline structure and the addition of a glass filler. It has good ultraviolet resistance, which is enhanced by the glass filler. Titanium oxide is added to give the material a white appearance instead of its natural light gray appearance. The white color contributes to increased reflectivity of usable light and minimizes absorption of ultraviolet light. Further, the thickness of the Valox® plastic in the above tests was approximately 2.0 millimeters thick.

From the foregoing tests, the most effective reduction of ballast operating temperature occurred through the use of metallized Valox® plastic, i.e., test 21, with average ballast component temperature drop of 20 degrees C., and secondarily, through the use of non-metallized but glossy Valox® plastic, i.e., test 20, with an average drop of 10 degrees C. Other tests showed that the use of non-metallized, non-glossy Valox® plastic in the color white mentioned above was still quite effective, although somewhat less so than the use of non-metallized but glossy Valox® plastic. It is preferred that the invention achieve a temperature drop of at least about one degree, and more preferably about three degrees, and still more preferably about five degrees or even more.

Many materials other than Valox® plastic can be used for implementing the thermal heat shield of the invention. For instance, Lexan® plastic can also be used. One formulation of Lexan® plastic that would be suitable is that sold with product number HF1110R-803 by General Electric Company of Fairfield, N.Y. Such material is of the polycarbonate family, and is amorphous in structure. It is especially well suited to precision molding of parts due to its uniform shrinkage when cooling. The material has high impact strength and is somewhat flexable, which allows thin cross-section parts to be molded and ejected without part breakage. It is also resistant to ultraviolet light. The −803 product code indicates a white color, with the same advantages due to the color white as mentioned above for Valox® plastic. A typical thickness For Lexan® plastic is 1.0 millimeters.

Although the thermal heat shield aspect of the present invention has been described with respect to a compact fluorescent lamp, it also applies to linear fluorescent lamps. Further, it applies to lamps of the foregoing type that are electroded, as well as those that are electrodeless, since the means (not shown) for transferring power to the lamp tubes in both cases generate a significant amount of heat.

From the foregoing, it will be realized that a first aspect of the present invention provides a lamp cathode-to-ballast interconnect and method of making such interconnection with minimal complexity and cost and that can be highly automated. A second aspect of the invention provides a fluorescent lamp in which ballast temperature is significantly reduced and ballast lifetime thus significantly lengthened, or in which the lamp can operate in a relatively hot environment such as in a recessed fixture.

While the invention has been described with respect to specific embodiments by way of illustration, many modifications and changes will occur to those skilled in the art. It is, therefore, to be understood that the appended claims are intended to cover all such modifications and changes as fall within the true scope and spirit of the invention.

What is claimed is:

1. A fluorescent lamp, comprising:

(a) a lamp tube having first and second ends, and containing fill materials for causing light generation when provided with electrical power;

(b) first and second power-transferring means at said first and second ends of said lamp tube, respectively, for providing said fill materials in said lamp tube with said electrical power;

(c) a support member for supporting at least the first end of said lamp tube;

(d) a housing for ballast circuitry; said housing being attached to said support member and being substantially free of ventilating apertures; and (e) a thermal heat shield separating said first power-transferring means from ballast circuitry which is contained within said housing, which supplies power to said first power-transferring means, and which has a lifetime that becomes substantially less as its operating temperature increases;

(f) said thermal heat shield being generally flat except for at least one cover for accommodating an end of said lamp tube;

(g) said thermal heat shield being substantially the sole thermal convective heat shield between said first power-transferring means and said ballast circuitry;

(h) said thermal heat shield being constructed so that it reflects back to said first power-transferring means and any adjacent portion of said lamp tube sufficient radiant energy to reduce the operating temperature of said ballast circuitry by more than about one degree Celsius compared with the absence of said heat shield.

2. The lamp of claim 1, wherein said thermal heat shield reflects back to said first power-transferring means and any adjacent portion of said lamp tube sufficient radiant energy to reduce the operating temperature of said ballast circuitry by more than about 5 degrees Celsius compared with the absence of said heat shield.

3. The lamp of claim 1, wherein said thermal heat shield includes a layer of metallization for enhancing reflectivity of radiant energy to said first power-transferring means and any adjacent portion of said lamp tube.

4. The lamp of claim 1, wherein said thermal heat shield comprises an opaque, light colored plastic material.

5. The lamp of claim 1, wherein said thermal heat shield comprises a generally thin material.

6. The lamp of claim 5, wherein said thermal heat shield includes a slot for passage therethrough of a cathode lead of the lamp.

7. A fluorescent lamp, comprising:

(a) a lamp tube having first and second ends, and containing fill materials for causing light generation when provided with electrical power; said lamp tube having a plurality of convolutions;

(b) first and second power-transferring means at said first and second ends of said lamp tube, respectively, for providing said fill materials in said lamp tube with said electrical power;

(c) a support member for supporting said first and second ends of said lamp tube;

(d) a housing for ballast circuitry; said housing being attached to said support member and being substantially free of ventilating apertures; and (e) a thermal heat shield separating said first power-transferring means from ballast circuitry which is contained within said housing, which supplies power to said first power-transferring means, and which has a lifetime that becomes substantially less as its operating temperature increases;

(f) said thermal heat shield being generally flat except for at least one cover for accommodating an end of said lamp tube;

(g) said thermal heat shield being substantially the sole thermal convective heat shield between said first power-transferring means and said ballast circuitry;

(h) said thermal heat shield being constructed so that it reflects back to said first and second power-transferring means and any adjacent portions of said lamp tube sufficient radiant energy to reduce the operating temperature of said ballast circuitry by more than about one degree Celsius compared with the absence of said heat shield.

8. The lamp of claim 7, wherein said lamp further comprises an Edison-type screw base for connection to an external source of power.

9. The lamp of claim 7, wherein said lamp tube comprises an amalgam tip for containing an amalgam.

10. The lamp of claim 9, wherein said lamp comprises filament-heated cathodes.

11. The lamp of claim 7, wherein said thermal heat shield reflects back to said first and second power-transferring means and any adjacent portion of said lamp tube sufficient radiant energy to reduce the operating temperature of said ballast circuitry by more than about 5 degrees Celsius compared with the absence of said heat shield.

12. The lamp of claim 7, wherein said thermal heat shield includes a layer of metallization for enhancing reflectivity of radiant energy to said first power-transferring means and any adjacent portion of said lamp tube.

13. The lamp of claim 7, wherein said thermal heat shield comprises an opaque, light colored plastic material.

14. The lamp of claim 7, wherein said thermal heat shield comprises a generally thin material.

15. The lamp of claim 14, wherein said thermal heat shield includes a slot for passage therethrough of a cathode lead of the lamp.

16. The lamp of claim 1, wherein said ballast circuitry includes an electrolytic capacitor.

17. The lamp of claim 7, wherein said ballast circuitry includes an electrolytic capacitor.

* * * * *